US005153061A

United States Patent [19]

Cavagna et al.

[11] Patent Number: 5,153,061

[45] Date of Patent: Oct. 6, 1992

[54] BARRIER COATING TO REDUCE MIGRATION OF CONTAMINANTS FROM PAPERBOARD

[75] Inventors: Giancarlo A. Cavagna, Silver Spring, Md.; Robinson C. Claytor, Covington, Va.

[73] Assignee: Westvaco Corporation, New York, N.Y.

[21] Appl. No.: 647,236

[22] Filed: Jan. 29, 1991

[51] Int. Cl.[5] ..... B32B 23/00; B32B 23/08

[52] U.S. Cl. ..... 428/325; 428/336; 428/408; 428/512; 428/514; 428/513; 427/395; 427/391

[58] Field of Search ..... 428/514, 474.4, 408, 428/513, 510, 512, 336, 325

[56] References Cited

U.S. PATENT DOCUMENTS

| | | | |
|---|---|---|---|
| 3,477,970 | 11/1969 | Beeman | 260/17 |
| 3,950,290 | 4/1976 | Drury, Jr. et al. | 428/511 |
| 4,157,995 | 6/1979 | Schenck | 260/29.6 |
| 4,421,825 | 12/1983 | Seiter | 428/332 |
| 4,777,088 | 10/1988 | Thompson et al. | 428/511 |

*Primary Examiner*—P. C. Sluby

*Attorney, Agent, or Firm*—Larry C. Hall; Richard L. Schmalz

[57] ABSTRACT

Barrier coatings are disclosed to reduce the migration of contaminants from paperboard into food products packaged in containers prepared from the paperboard. The barrier coatings operate to either absorb the contaminants or provide a tortuous path to their migration from the paperboard particularly at the high temperatures reached during the cooking of the food products in microwave ovens.

8 Claims, No Drawings

BARRIER COATING TO REDUCE MIGRATION OF CONTAMINANTS FROM PAPERBOARD

BACKGROUND OF INVENTION

The present invention relates to the treatment of paperboard intended for packaging foodstuffs in order to prevent or inhibit the migration of contaminants from the paperboard into the packaged foodstuffs. Paperboard contaminants even at low concentrations may migrate into foodstuffs packaged in containers made from the paperboard depending upon the solubility and diffusivity characteristics of the paperboard, the foodstuff itself and any barrier coatings applied to the paperboard in the normal course of manufacture. These contaminants which may be perceived either as toxic or as obnoxious because of their health hazard or because they create odor or flavor changes in the food products are objectionable. In particular chlorinated organic compounds such as tetrachlorinated dibenzo-p-dioxin (2,3,7,8-TCDD) and tetrachlorinated dibenzo-p-furan (2,3,7,8-TCDD) which are present in most bleached paperboard products are a cause for concern of the paperboard manufacturer.

It is known in the art of paperboard manufacture to apply coatings to the surface of paperboard for various reasons. For instance, U.S. Pat. No. 4,421,825, discloses the application of a coating comprising titanium dioxide and an acrylic copolymer to paperboard to minimize browning of the paperboard at temperatures up to about 205 degree C. It is also known in the art to apply barriers to the paperboard surface, particularly the food contact surface of the paperboard, to satisfy FDA requirements for safe packaging. These barriers usually take the form of polymer coatings which have achieved FDA clearance for food contact or they may be in the form of a layer of aluminum foil laminated to the paperboard surface. Polyethylene (LDPE, HDPE, LLDPE), ethylene vinyl alcohol copolymers (EVOH), polyvinlyidene chloride (PVDC), nylon, and polyethylene terephthalate (PET) coatings are examples of such barriers. Nevertheless, such barrier materials are not applicable to every packaging situation, particularly where it is desired to keep contaminants such as 2,3,7,8-TCDD and 2,3,7,8-TCDF from the food product, especially at high temperatures.

Studies have shown that at the high temperatures foods may reach in a microwave oven for example, the solubility of 2,3,7,8-TCDD and 2,3,7,8-TCDF is greater in almost every barrier material proposed for use in the food industry today than in paperboard. Moreover, the rate of diffusivity of both 2,3,7,8-TCDD and 2,3,7,8-TCDF has been found to be greater through those materials than through paperboard. Thus the application of conventional barrier materials to paperboard intended for packaging foodstuffs for use in microwave ovens may not be sufficient to attain a contaminant free food product. At cooking temperatures of 225° F. or less, the most up-to-date analytical methods for measuring the presence of 2,3,7,8-TCDD and 2,3,7,8-TCDF has not been able to detect the presence of these contaminants in food. However, at temperatures in excess of 225° F., measurable levels of 2,3,7,8-TCDD and 2,3,7,8-TCDF have been found to migrate from the bleached paperboard into food products. Thus it is presumed that high temperatures are required to motivate these contaminants to migrate from the paperboard to the food product, presumably in the vapor phase. However, for migration within the paperboard, high temperatures are not required.

Accordingly, the present invention was developed to provide a means for reducing and perhaps eliminating the migration of unwanted contaminants from bleached paperboard to food products packaged in containers prepared from the paperboard.

SUMMARY OF THE INVENTION

The present invention is directed essentially to a method and means for inhibiting the transfer of contaminants found in bleached paperboard into products, particularly food products, packaged in containers fabricated from the bleached paperboard. Chlorinated compounds from the bleaching process found at low concentrations in bleached paperboard can migrate into foodstuffs contained in a paper board package. To counteract this tendency, either an absorbing or a tortuous barrier coating can be applied to the surface of the bleached paperboard. If the coating is of the absorbent type, it can be applied to either the inner surface of the paperboard or to the outer surface of the paperboard since in any event it will perform as a sink to absorb the unwanted contaminants and thus hinder or prevent their migration to the packaged foodstuffs. If the coating is of the tortuous barrier type, it is preferably applied only to the inner surface of the bleached paperboard between the paperboard and a film of plastic or the like, to provide a food contact surface, where the coating provides a tortuous path for the migration of unwanted contaminants. According to the present invention, the preferred active ingredient in an absorbent coating is activated carbon, for example NUCHAR S-20 activated carbon, a product of Westvaco Corporation, the assignee herein. Activated carbon is widely used in many applications for its absorbent qualities. However, it is not generally recognized as a pigment for use in paper coatings. Thus the preference for the use of this material in the absorbent coating of the present invention is deemed to be novel. Further, this pigment is preferably used in combination with a lipophilic binder (having an affinity for the fat soluble contaminants). This combination contributes to the performance of the coating in absorbing and holding the contaminants. Meanwhile, the preferred active ingredient in the tortuous barrier type coating of the present invention is a delaminated clay product, examples of which are NUCLAY or SAMTONE delaminated clay products supplied by Huber Corporation. The particle size and shape of the clay pigment is essential to producing a suitable barrier coating for inhibiting the migration of any contaminants through the coating. For the tortuous barrier type coating, the pigment is preferably dispered in a lipophobic binder (having little affinity for the fat soluble contaminants), which acts as an agent to improve the barrier properties of the coating.

For example, Kaolin (clay) is the pigment most widely used for paper coatings because of its chemical and physical properties and its low cost. However it is known that Kaolin deposits include minor components of nonkaolinite clay materials. In addition to Kaolinite, the clay minerals most likely to be encountered are montmorillonite, halloysite, attapulgite and illite. Both montmorillonite and illite consist essentially of thin, illformed, sheet-like particles of high aspect ratio on the order of 8–10 to 1 (width to thickness of the particles) which provides the most tortuous barrier to hinder migration of contaminants. However, these nonkaolinite clay materials are generally unsuitable as paper coating pigments because of their excessively high viscosities. Accordingly the preference for these materials in the trapping coating of the present invention is deemed to be novel.

DETAILED DESCRIPTION

In accordance with the present invention, either an absorbing or tortuous barrier coating may be applied to bleached paperboard intended for the packaging of food products to reduce the migration of 2,3,7,8-TCDD or 2,3,7,8-TCDF contaminants and other chlorinated compounds from the bleached paperboard into the packaged food product. Most bleached paperboard products made today contain 2,3,7,8-TCDD and 2,3,7,8-TCDF components in low concentrations. It is the purpose of the present invention to provide an absorbing or tortuous barrier coating either alone or in combination with a conventional polymeric food contact coating normally applied to foodboard to protect the packaged foodstuffs from contamination.

Most coatings for paperboard comprise pigments and binders in varying concentration. Since the pigment component of a paper coating constitutes the major portion of the coating, the pigment component will have the greatest impact on the barrier qualities of the coating. For the purposes of the present invention, the pigment variables are divided into two groups, (1) a sorbing pigment for absorbing the undesired contaminants, or (2) a shingling pigment to provide a tortuous path for any migration of the unwanted contaminants from the paperboard.

The absorbing coating, comprising an absorbing pigment and a lipophilic binder may be applied to the inner surface of the paperboard between the paperboard and the conventional polymeric food contact coating normally used to enhance the barrier properties of the polymeric coating. In this position, the absorbent pigment traps and holds the migrating species before they reach the conventional polymeric food contact coating. Alternatively, the absorbing coating can be applied to the outer surface of the paperboard away from the food contact side. In this position the absorbing coating absorbs the migrating species from the paperboard and holds them, thus depleting the paperboard of the migrating species, and preventing them from migrating back into the paperboard and eventually to the packaged foodstuffs. Studies have shown that it is possible for the contaminants to migrate within the paperboard even at ambient temperatures. In such instance, the adsorbing coating when applied to either side of the paperboard would act as a sink beginning at the time of manufacture of the paperboard. Since any such migration would occur over an extended period of time on the order of 5 to 10 days, sufficient time would be available between the manufacturing step and the converting and filling steps to allow the contaminants to collect in the coating even before cooking is carried out.

The tortuous barrier coating is preferably applied adjacent to the inner surface of the paperboard and between the paperboard and the food contact polymeric film. This type of barrier coating utilizes shingling pigments with particles having high aspect ratios and binders that are lipophobic to maximize the resistance to migration of the unwanted contaminants. The tortuous barrier coating is also preferably calendered or compressed to seal the surface of the coating and pack the pigment particles down to provide the most torturous path possible for any migrating species.

In order to evaluate this concept, coatings were prepared using sorbing and shingling pigments. The binder used in the sorbing-pigment experiments was Dow 620 styrene butadiene latex and the pigment was NUCHAR S-20 activated carbon. The shingling pigment coatings used NUCLAY delaminated pigment and polyvinyl alcohol as binder. All coatings were mixed with a high shear mixer until the coatings were fully dispersed. Water was added to reduce the viscosity to a level which would allow the coatings to be applied to paperboard using conventional coating methods (viscosity 1,000 to 7,500 cps).

The coatings were then applied to paperboard samples (20 point PRINTKOTE paperboard manufactured by Westvaco Corporation) as drawdowns using a wire rod. The average coat weights of the NUCHAR/SBR coating were about 15 pounds per 3000 square feet of paperboard and about 8 pounds per 3000 square feet for the NUCLAY/PVA coating. The actual coat weights for the NUCHAR/SBR coating ranged from 12–18 pounds per 3000 square feet and for the NUCLAY/PVA coating from 6–10 pounds per 3,000 square feed of paperboard. The Nuclay/PVA coated paperboard was calendered in sheet form at 350 degrees F., 200 pli, and 600 fpm using a laboratory soft roll calender. After coating, a polymeric food contact coating of polyethylene terephtalate (PET) was extruded over the coated surface of the paperboard at a coat weight of about 26 pounds per 3000 square feet.

Samples of the coated paperboard measuring approximately 9×8 inches were folded and stapled to form a boat-like tray structure. 250 grams of corn oil was placed into each tray and covered with a 10 inch watch glass. The oil was cooked at 412 degrees F. in a Toastmaster convection oven for 30 minutes. The trays were then allowed to cool for 30 minutes before 200 grams of the corn oil was removed from each tray, packaged, frozen and sent for analysis at Enseco-Cal Laboratories. This analysis showed that the tested structures reduced 2,3,7,8-TCDD and 2,3,7,8-TCDF migration into the corn oil during cooking.

There was a general reduction in the migration of 2,3,7,8-TCDD and 2,3,7,8-TCDF when any of the experimental coatings were used. The sorbent coating reduced 2,3,7,8-TCDD migration by 48–58%. The side of the board to which the coating was applied did not have a significant effect on the reduction in 2,3,7,8-TCDD migration. This is consistent with the hypothesis provided hereinbefore regarding the absorbent coating being a sink for the contaminants in the paperboard. 2,3,7,8-TCDF migration was reduced more when the sorbent coating was applied under the PET layer on the food contact surface. Migration was reduced up to 55% when the sorbent coating was applied under the PET layer. When applied to the outer surface of the paperboard sample, migration was reduced by 25%.

The greatest reduction in the migration of 2,3,7,8-TCDD and 2,3,7,8-TCDF was achieved using the tortuous barrier coating under the PET layer. This coating reduced the migration of 2,3,7,8-TCDD to a nondetectable level and 2,3,7,8-TCDF by almost 80%. Further, the tortuous barrier coating was found to be more practical to use than the sorbent coating since the tortuous barrier coating is white and can be applied using conventional coating technology.

The foregoing description of the preferred embodiments of the present invention is presented solely for the purpose of illustration and description. It is not intended to be exhaustive or to limit the invention to the precise form disclosed. Obvious modifications and variations are possible in light of the teachings presented. For example, the choice of pigment used in either the sorbing coating or the tortuous barrier coating is dependent on the final product desired and the type of coating equipment available for use. Likewise the pigment-/binder ratio may be revised as required and the viscosity adjusted for the coating equipment used.

Such modifications and variations are believed to fall within the scope of the invention as determined by the appended claims when interpreted in accordance with the breadth they are legally entitled.

What is claimed is:

1. A method for reducing the migration of tetrachlorinated dioxin and furan (2,3,7,8-TCDD and 2,32,7,8-TCDF) contaminants from a bleached paperboard substrate comprising applying to a surface of the paperboard a coating composition selected from the group consisting of sorbing coatings which trap and hold the migrating contaminants and tortuous barrier coatings utilizing shingling pigments which provide a tortuous path through the coatings for the migrating contaminants, said coating composition serving to inhibit the migration of the contaminants from the paperboard under conditions where the paperboard substrate is exposed to elevated temperatures in excess of 225° F., said coating composition comprising a mixture of pigments and binders which are applied to the paperboard substrate with a paper coating apparatus.

2. The method of claim 1 wherein the sorbing coating comprises a lipophilic binder with an affinity for the fat soluble contaminants having dispersed therein an activated carbon pigment in a pigment-to-binder ratio of about 125/100 at a viscosity of about 2500–3000 cps.

3. The method of claim 1 wherein the tortuous barrier coating comprises a lipophobic binder with little affinity for the rat soluble contaminants having dispersed therein a clay pigment consisting essentially of illite and montmorillonite components in a pigment-to-binder ratio of about 100/45 at a viscosity of about 2500–3000 cps.

4. A bleached paperboard product resistant to the migration of chlorinated organic compounds therefrom at temperatures in excess of 225° F., said product comprising a paperboard substrate coated on at least one surface thereof with a plurality of distinct coating compositions comprising a first barrier coating selected from the group consisting of sorbing coatings which trap and hold the migrating compounds and tortuous barrier coatings utilizing shingling pigments which provide a tortuous path through the coating, said coating acting to inhibit the migration of compounds from the paperboard, and one or more overcoatings of a polymeric material suitable for food contact wherein the first barrier coating and the one or more coatings have a combined thickness of at least about one mil.

5. The paperboard product of claim 4 wherein the sorbing coating comprises a lipophilic binder with an affinity for the fat soluble compounds having dispersed therein an activated carbon pigment in a pigment-to-binder ratio of about 125/100 and a viscosity of about 2500–3000 cps.

6. The paperboard product of claim 4 wherein the tortuous barrier coating comprises a lipophilic binder with little affinity for the fat soluble compounds having dispersed therein a clay pigment consisting essentially of illite and montmorillonite components in a pigment-to-binder ratio of about 100/45 and a viscosity of about 2500–3000 cps.

7. A paperboard product for use in the manufacture of ovenable food packages which is resistant to the migration of chlorinated organic compounds at temperatures in excess of 225° F., said product comprising a bleached paperboard substrate having applied to at least one surface thereof a first coating composition comprising a microporous activated carbon pigment dispersed in solution including a lipophilic binder selected from the group consisting of styrene butadiene, modified styrene butadiene, polyolefins, and vinyl acetate, said microporous pigment being present in said first coating in amounts ranging from about 100 parts pigment to about 50–300 parts by weight of the lipophilic binder, and a second coating composition applied over said first coating composition or to the opposite surface of said paperboard substrate, said second coating composition comprising an extruded polymeric film suitable for food contact use.

8. A paperboard product for use in the manufacture of ovenable food packages which is resistant to the migration of tetrachlorinated dioxin and furans (2,3,7,8-TCDD and 2,3,7,8-TCDF) at temperatures in excess of 225 degrees F., said product comprising a bleached paperboard substrate having applied to one surface thereof a first barrier coating composition comprising an inorganic clay pigment consisting essentially of illite and montmorillonite components having particles with aspect ratios in the range of from about 8–10 to 1 (width to thickness), dispersed in a solution of a lipophobic binder selected from the group consisting of polyvinyl alcohol, polyacrylate and polyamide binders, said clay pigment being present in said first barrier coating in an amount ranging from about 100 parts pigment to about 50–300 parts by weight of the lipophobic binder, and a second barrier coating composition applied over said first barrier coating composition to provide a safe food contact surface, said second barrier coating composition comprising a polymer material approved for food contact by the FDA.

* * * * *